United States Patent [19]

McCord

[11] 4,173,831

[45] Nov. 13, 1979

[54] EGG DRYING APPARATUS

[75] Inventor: Robert C. McCord, Romulus, Mich.

[73] Assignee: Diamond International Corporation, New York, N.Y.

[21] Appl. No.: 900,138

[22] Filed: Apr. 26, 1978

[51] Int. Cl.[2] ..... F26B 19/00

[52] U.S. Cl. ..... 34/236; 34/71; 426/300

[58] Field of Search ..... 34/236, 71, 21, 22, 34/34, 83, 104, 105; 426/298, 300; 99/483

[56] References Cited

U.S. PATENT DOCUMENTS

| | | | |
|---|---|---|---|
| 1,447,494 | 3/1923 | Strawn | 34/236 |
| 1,691,874 | 11/1928 | White | 34/236 X |
| 2,315,246 | 3/1943 | Cunning | 34/236 X |
| 2,588,787 | 3/1952 | Wright | 34/71 |
| 2,720,153 | 10/1955 | Barth | 99/483 |

*Primary Examiner*—Edward G. Favors
*Attorney, Agent, or Firm*—Kenyon & Kenyon

[57] ABSTRACT

An egg drying apparatus is disclosed incorporating an improved laminar air flow for more effectively drying eggs. The orifices for discharging and directing air towards the eggs to be dried have a coefficient of discharge of at least about 0.8. The orifices are disposed in the bottom of a chamber and are formed by adjacently spaced elongated members having curved air contacting surfaces along the longitudinal axis of each member. A fan draws air into the chamber which is directed towards the eggs via the orifices. In the preferred embodiment, the coefficient of discharge of the orifices is about 0.9 and curved portions of the elongated members are U-shaped channels with the exterior of adjacent channels forming the orifices.

11 Claims, 3 Drawing Figures

EGG DRYING APPARATUS

BACKGROUND OF THE INVENTION

The present invention relates to drying apparatus and more particularly to apparatus for drying eggs.

Production of eggs is highly automated with the eggs being transported to and through a series of automated operations from collecting to packing. Therefore, any of the operations which does not keep pace with the remainder of the system will impede the rate of production. Included in such automatic operations are egg washing and drying. Although certain of the components are capable of high speed operation, drying has heretofore required a greater amount of time and thus limited the overall capacity of the system. By the means disclosed herein, an improved drying means is provided which is suitable for use in high capacity and high speed automated egg processing systems.

SUMMARY OF THE INVENTION

It is therefore an object of the present invention to provide egg drying apparatus of high capacity.

It is another object of the present invention to provide egg drying apparatus having an increased air flow volume.

It is still another object of the present invention to provide egg drying apparatus having increased air velocity.

It is yet another object of the present invention to provide egg drying apparatus having reduced noise levels.

These and other objects of the present invention are achieved by providing elongated air discharge orifices for discharging and directing drying air towards the eggs in an egg drying apparatus, the orifices having a coefficient of discharge of at least about 0.8. In accordance with the present invention, the orifices for discharging the air towards the eggs to be dried are formed by opposed elongated surfaces, the air contacting portions of which are curved along the longitudinal axis of the elongated member.

The egg drying apparatus according to the present invention includes means for directing air towards the eggs being advanced through the apparatus. Also included is a conveyor means for advancing eggs past the air directing means which is in communication with an air displacement means for moving air therethrough. A chamber which is disposed adjacent the air displacement means houses the air directing means. The air directing means includes a plurality of elongated orifices disposed in the bottom of the chamber, the orifices being positioned above the conveyor means to discharge air towards the eggs being advanced by the conveyor means. As mentioned, the orifices have a coefficient of discharge of at least about 0.8.

In accordance with the disclosed embodiment of the invention, the orifices extend substantially parallel to the direction of movement of the eggs which are advanced on the conveyor means in a plurality of juxtaposed columns. Each orifice extends and is positioned to discharge air towards a respective column of eggs, preferably towards the central portion thereof. The eggs are preferably advanced with the major axis thereof substantially normal to the direction of advancement of the eggs with each orifice extending substantially normal to said major axis. The orifices are formed by adjacently spaced members having air contacting surfaces which are curved. Each of the elongated members is a generally U-shaped or semi-cylindrical channel which is disposed so that the exterior of the channel faces the interior of the chamber, adjacent members thereby forming orifices which are defined by the curved air contacting surfaces of the channels.

These and other aspects of the invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which:

FIG. 3 is a perspective view depicting the discharge orifices according to the invention.

DESCRIPTION OF THE PREFERRED EMBODIMENT

Figure 1:
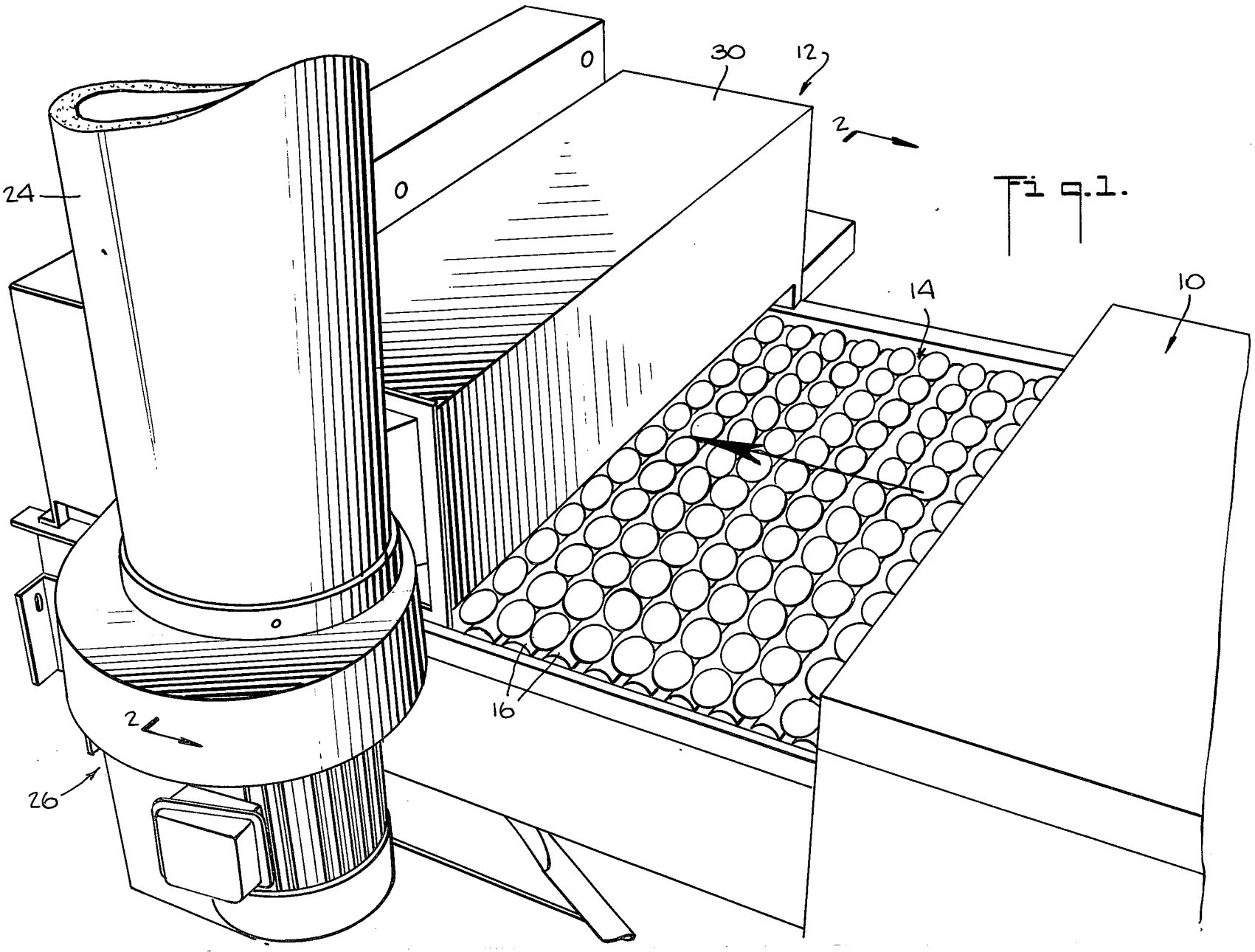
FIG. 1 is a perspective view of the egg drying apparatus according to the invention.

Referring now particularly to the drawings, an egg dryer according to the invention is illustrated. As shown in FIG. 1, the eggs, emerging from an egg washer 10, are advanced towards the egg dryer 12 on a conveyor 14. The conveyor 14 includes spindles 16 which are juxtaposed and interconnected to form an endless loop. Each of the spindles 16 (FIGS. 2 and 3) includes a plurality of adjacently arranged, inwardly-tapered or concave portions 17 generally contoured to accommodate the shape of an egg. Each of the portions 17 is separated by a tubular portion 18. The tapered and tubular portions of adjacent spindles are aligned and the spindles spaced so that adjacent tapered portions of adjacent spindles form a cradle for carrying an egg therein with the major axis of the egg being parallel to the axis of the spindle. Thus, the eggs are aligned in a plurality of rows separated by the aligned tubular portions 18, and the eggs are advanced with the major axis being normal to the direction of advancement of the eggs. The eggs accordingly enter the egg dryer 12 in a plurality of aligned columns as shown in FIG. 1.

The spindles are freely rotatably about shafts 19 extending therethrough. The ends of the shafts are interconnected by an endless linkage system 20 by means of which an endless loop of spindles is formed and interconnected to form the conveyor surface. The spindles 16 are supported at opposed tubular ends 21 thereof on tracks 22, the ends of the spindles riding on the surface of the tracks. The tubular spindle ends 21 riding on the track surfaces act as wheels causing the spindles to rotate about the shafts as they are advanced. Accordingly, the eggs are continually rotated about their major axes as they are advanced through the dryer.

Air is drawn into the egg dryer through an inlet muffler 24 by a high-speed, low displacement squirrel cage fan 26. The fan creates a partial vacuum to draw air into the muffler. The inlet muffler 24 is cylindrically shaped and includes walls having acoustic foam 28 therein to reduce noise. A plenum chamber 30 is positioned above the advancing eggs in communication with muffler 24 by means of a connecting section 32 adjacent fan 26

Figure 2:
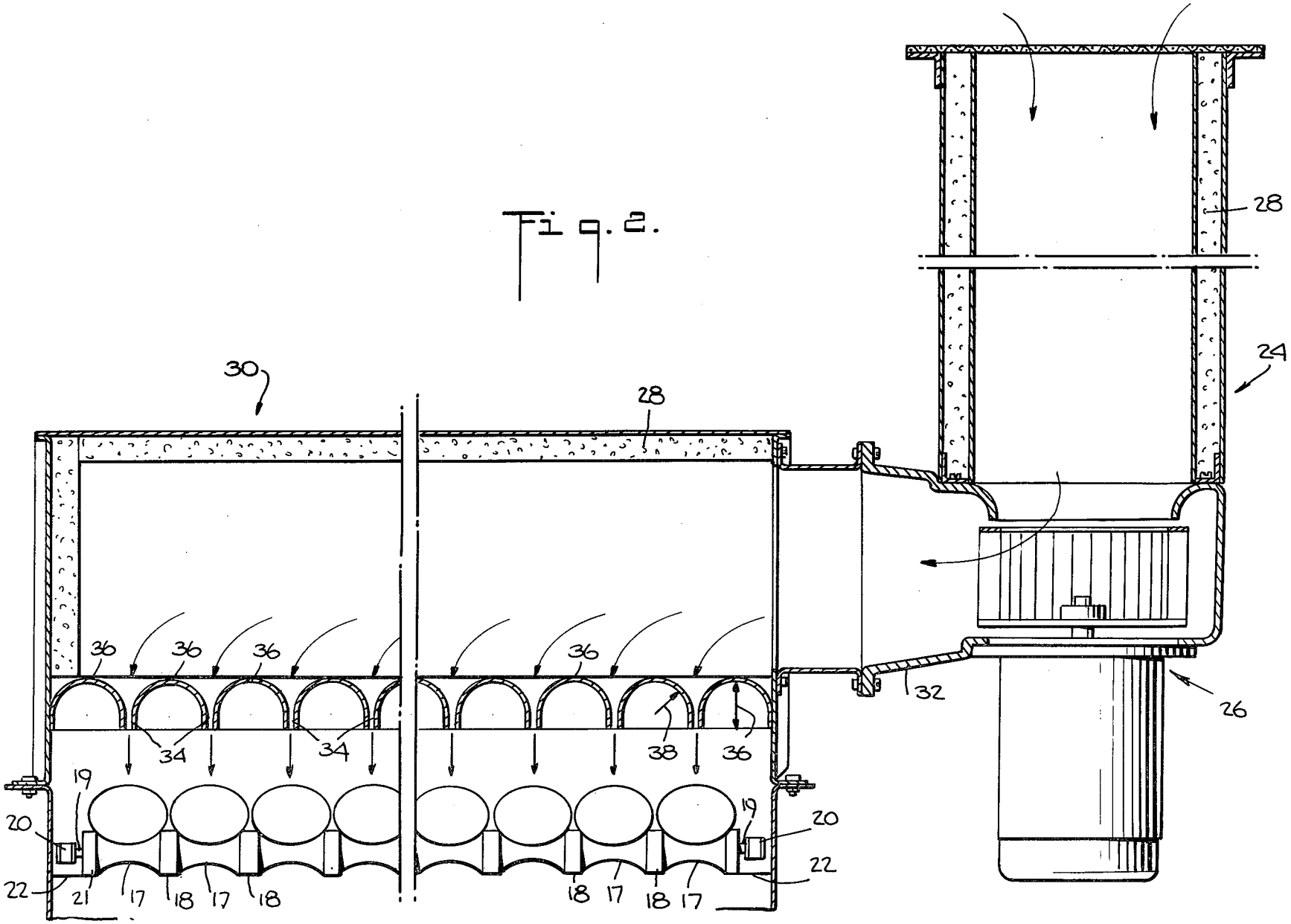
FIG. 2 is an elevational view, partly in cross section taken along line 2—2 of FIG. 1 and depicting the discharge orifices according to the invention.
Figure 8:
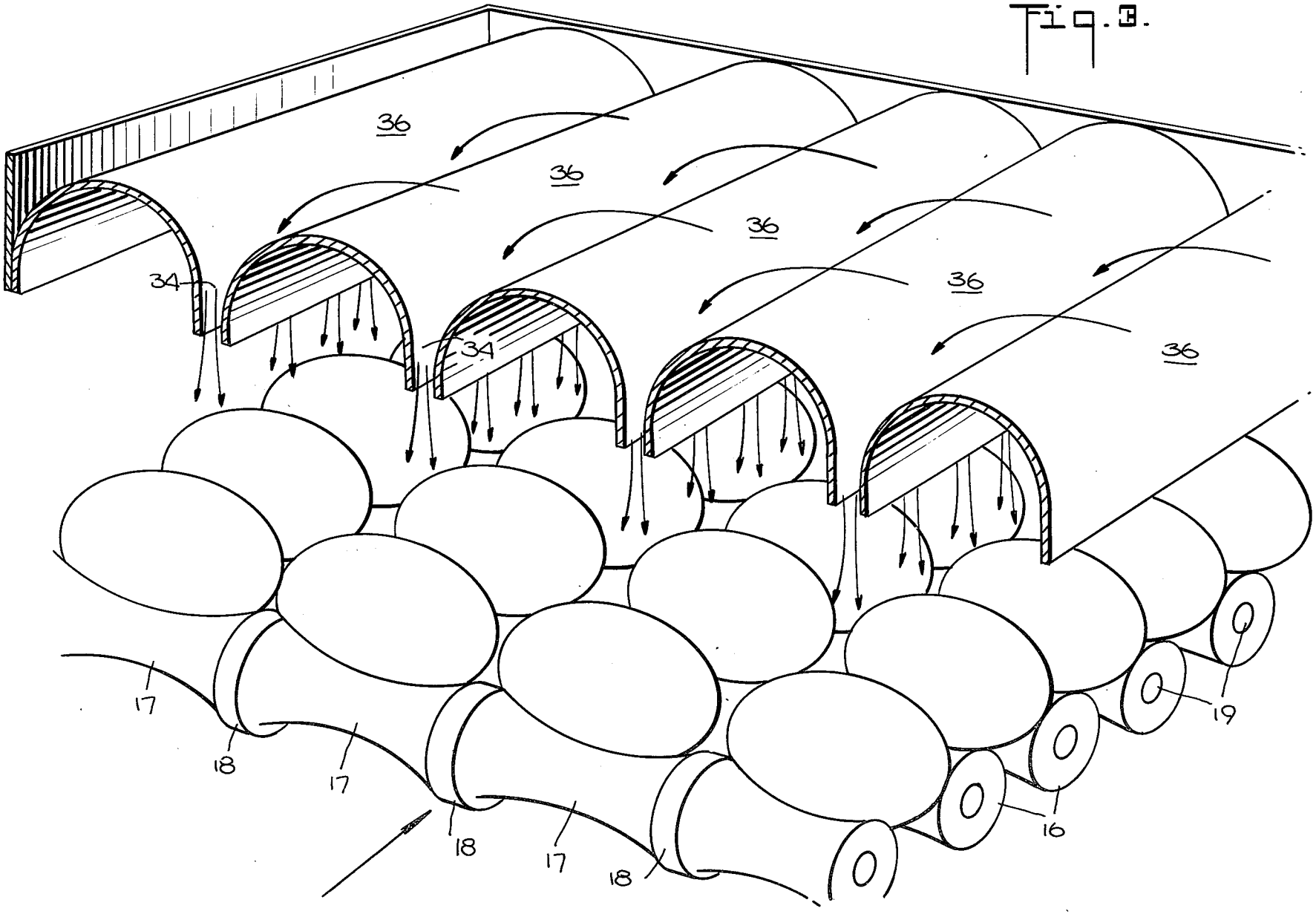

(FIG. 2). The plenum chamber 30 is of rectangular configuration and extends across the width of the conveyor. The walls of the chamber are also filled with acoustic foam 28. A plurality of parallel orifices 34 are formed in the bottom of the chamber by a plurality of U-shaped channels 36, which are supported at the ends thereof by the chamber walls. A channel is provided for each column of eggs, and the columns of eggs and the superposed channels are offset such that the spaces or orifices between the channels are located above the central part of the eggs being advanced below the channels. The orifices are formed from the contoured or curved surfaces of the adjacently spaced channels. The contoured air contacting surfaces produce an improved laminar air flow through each orifice with the coefficient of discharge of the orifice being at least about 0.8. Preferably and with the elongated members disposed and shaped as herein described, the coefficient of discharge is about 0.9.

The length of the channels is sufficient to extend the width of the chamber while rotation of the eggs therebeneath insures that all egg surfaces are exposed to drying air as the eggs are advanced through the dryer. The channels are spaced from one another by a distance such that with the radius of the channels, the orifice thus formed produces a flow which closely approximates laminar flow. Thus, as mentioned, a coefficient of discharge of about 0.9 is preferred in order to insure rapid and adequate drying.

Referring to FIG. 2, air is drawn into muffler 24 by means of fan 26 and is thus supplied to the interior of chamber 28. The air flows across the contoured surfaces of the channel members 36 and is discharged under pressure from the chamber through orifices 34. The streams of air are discharged through the elongated orifices 34 formed between channels 36, with the flow through each orifice being directed toward the central portion of the eggs. Thus, the eggs are continuously dried as they advance below the elongated orifices. The contoured air contacting surfaces of the channel members provide a laminar air flow, thus reducing turbulence and noise. This decrease in turbulence permits a higher displacement of air volume at a higher velocity through the orifice with the same or equivalent pressure head. Accordingly the same size fan, as used with dryers providing turbulent air flow, can be used in accordance with the invention to obtain more efficient drying.

Although the above description is directed to a preferred embodiment of the invention, it is noted that other variations and modifications will be apparent to those skilled in the art and, therefore, may be made without departing from the spirit and scope of the present disclosure.

What is claimed is:

1. An egg drying apparatus comprising conveyor means for advancing eggs through said apparatus, air displacement means for moving air towards said eggs being conveyed through said apparatus, a chamber in communication with said air displacement means, air directing means disposed in said chamber and in communication with said air displacement means for directing air towards eggs being advanced through said apparatus, said air directing means including a plurality of elongated orifices disposed in the bottom of said chamber, said orifices being positioned above said conveyor means to discharge air towards eggs being advanced by the conveyor means, each of the orifices having a coefficient of discharge of at least about 0.8.

2. The egg drying apparatus as recited in claim 1, wherein said orifices have a coefficient of discharge of about 0.9.

3. The egg drying apparatus as recited in claim 1, wherein said orifices extend substantially parallel to the direction of advancement of the eggs.

4. The egg drying apparatus as recited in claim 3, wherein said conveyor means includes means for advancing the eggs in a plurality of juxtaposed columns.

5. The egg drying apparatus as recited in claim 4, wherein said orifices extend and are positioned to discharge air towards a location on the conveyor means corresponding to the location of a respective column of eggs.

6. The egg drying apparatus as recited in claim 5, wherein each orifice extends and is positioned to discharge air towards a location corresponding to the location of the central portion of a respective column of eggs.

7. The egg drying apparatus as recited in claim 6, wherein said conveyor means advances the eggs with the major axes thereof disposed substantially normal to the direction in which the eggs are advanced, and wherein said orifices extend substantially normal to the major axes of the eggs being conveyed through said apparatus.

8. The egg drying apparatus as recited in claim 5, wherein each of said orifices is formed by a pair of spaced, elongated curved members which form an orifice therebetween.

9. The egg drying apparatus as recited in claim 5, wherein each of said orifices is formed by a plurality of elongated members dispósed in a spaced, parallel relationship in the bottom of said chamber such that adjacent spaced members form a respective elongated orifice, each of said elongated members having the air contacting surface thereof curved.

10. The egg drying apparatus as recited in claim 9, wherein the curved surface of each of the members which contacts the air moving through the chamber is generally U-shaped.

11. The egg drying apparatus as recited in claim 4, wherein the conveyor means includes means for rotating the eggs about their major axes as they are advanced through the apparatus.

* * * * *